United States Patent [19]

Cole

[11] 4,078,753

[45] Mar. 14, 1978

[54] BRACKET FOR DISPLAYING AND STORING MUSICAL INSTRUMENTS

[76] Inventor: Ross W. Cole, Rte. 1, Jetmore, Kans. 67854

[21] Appl. No.: 722,787

[22] Filed: Sep. 13, 1976

[51] Int. Cl.[2] ..... A47F 5/00

[52] U.S. Cl. ..... 248/204; 211/13; 248/302; 248/309 R; 248/317

[58] Field of Search ..... 248/309, 311, 312, 313, 248/315, 316, 317, 303, 305, 302, 300, 110–112, 204; 211/13

[56] References Cited

U.S. PATENT DOCUMENTS

| | | | |
|---|---|---|---|
| 1,103,491 | 7/1914 | Cormier | 248/302 X |
| 1,703,445 | 2/1929 | Harding | 248/312 |
| 2,051,408 | 8/1936 | Karst | 248/110 X |
| 2,089,743 | 8/1937 | Golden | 248/312 |

FOREIGN PATENT DOCUMENTS

| | | | |
|---|---|---|---|
| 980,118 | 12/1950 | France | 248/302 |
| 107,823 | 11/1924 | Switzerland | 248/112 |
| 402,252 | 11/1933 | United Kingdom | 248/312 |

*Primary Examiner*—Roy D. Frazier
*Assistant Examiner*—Peter A. Aschenbrenner
*Attorney, Agent, or Firm*—Edwin H. Crabtree; John H. Widdowson

[57] ABSTRACT

A bracket for displaying and storing musical instruments such as guitars, banjos, mandolins, fiddles, or the like. The bracket suspends the instrument by its neck. The bracket may be attached to a wall or ceiling, or suspended from a ceiling by a chain.

3 Claims, 3 Drawing Figures

BRACKET FOR DISPLAYING AND STORING MUSICAL INSTRUMENTS

Background of the Invention

This invention relates generally to brackets for displaying and hanging devices from a wall or ceiling and more particularly, but not by way of limitation, to a bracket for displaying and storing musical instruments.

Heretofore, there have been various types of stands for supporting drums, stringed instruments, or the like thereon. These type stands are floor mounted and are complex in structure. Also, these stands do not provide for displaying a stringed instrument nor are they used for storing the instrument. The prior art stands are generally used for supporting the instrument while it is being played.

The following described invention provides a novel bracket for displaying stringed musical instruments.

SUMMARY OF THE INVENTION

The subject invention provides an inexpensive bracket for effectively displaying and storing stringed musical instruments. The bracket compliments the displaying of the instruments in music stores.

The bracket can be easily attached to a wall or a ceiling or suspended from a ceiling by a chain. The bracket suspends the musical instrument by its neck and prevents the jarring or bumping of the tuning keys of the musical instrument which often happens when the musical instrument is placed in its respective case or leaned against a wall.

Also, the bracket prevents the warping or bowing of the musical instrument neck which often happens when the instrument is improperly stored.

Through the use of the invention, the musical instrument is displayed so that access to the instrument is readily available thereby encouraging the practice of the instrument as opposed to the instrument being stored out of sight.

The bracket allows the musical instrument to be stored at a height so that children or animals are prevented from coming in contact with the instrument.

The arms of the bracket are covered with a plyable material to prevent the neck of the instrument from becoming marred when it is displayed or stored thereon.

The bracket has parallel and adjacent arms which can be adjusted to various widths therebetween so that stringed instruments having different neck widths can be suspended therefrom.

The bracket includes a vertically disposed resilient ring. The ring is open at its lower portion with the ends of the open ring extending outward forming adjacent arms for receiving the neck of the musical instrument therebetween.

The advantages and objects of the invention will become evident from the following detailed description when read in conjuction with the accompanying drawings which illustrate the preferred embodiments of the invention.

DETAILED DESCRIPTION OF THE DRAWINGS

Figure 1:
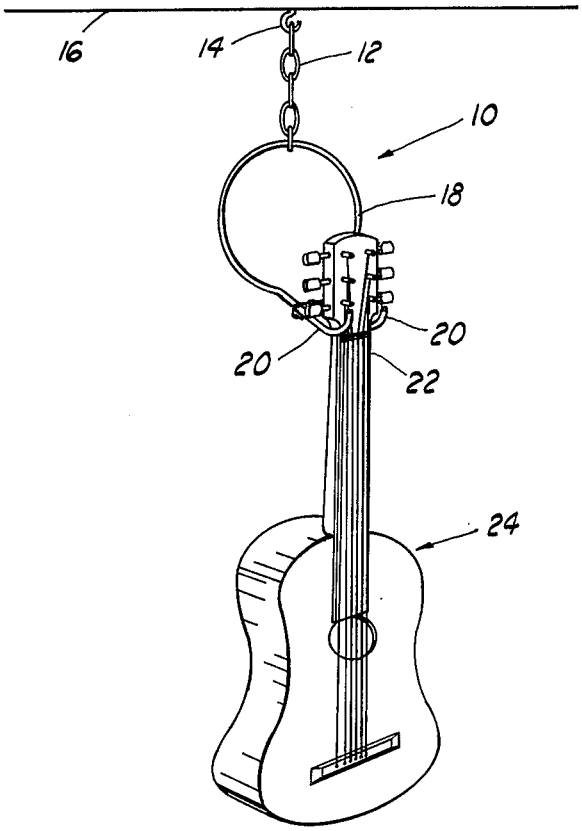
FIG. 1 is a perspective view of the bracket suspending a guitar therefrom.

In FIG. 1, the bracket for displaying musical instruments is designated by general reference numeral 10. In this view, the bracket 10 is attached to a chain 12 which in turn is attached to a hook 14 secured to a ceiling 16. The bracket 10 includes a vertically disposed resilient ring 18. The ring 18 is open at its lower portion with the ends thereof extending outwardly forming parallel and adjacent arms 20 for receiving a neck portion 22 of a guitar 24. While a guitar 24 is displayed in FIG. 1, it can be appreciated that any number of different types of stringed musical instruments can be suspended between the arms of the bracket 10.

Figure 2:
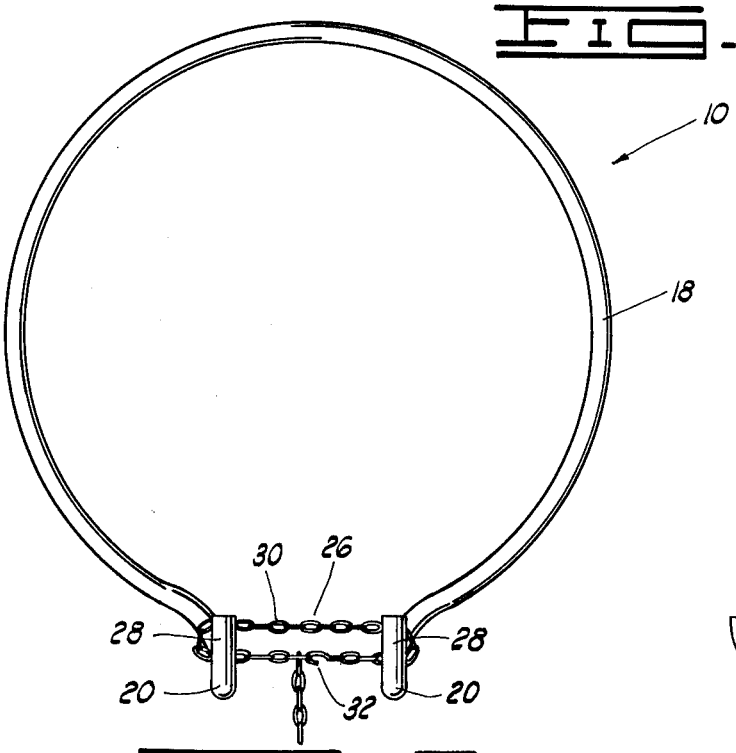
FIG. 2 is a front view of the bracket.

In FIG. 2, a front view of the bracket 10 is illustrated. In this view, an open lower portion 26 of the ring 18 is shown. The ends of the ring 18 extend outwardly toward the viewer and are curved upward forming a hook portion 28 of the arms 20. The hook portion 28 of the arms 20 prevent the musical instrument from sliding off the ends of the arms 20. The ring 18 is made of a resilient material such as steel or the like. While a metal such as steel may be used it should be appreciated that any other type of metallic or non-metallic material may be used equally well provided that the material is resilient in construction.

Because of the resiliency of the ring 18 it can be compressed and the width between the parallel and adjacent arms 20 can be adjusted by applying an adjustable link chain 30 around the arms 20. One end of the chain 30 has a hook 32 which is inserted into one of the links of the chain 30 thereby allowing the width between the arms 20 to be adjusted for receiving the neck of the musical instrument.

Figure 3:
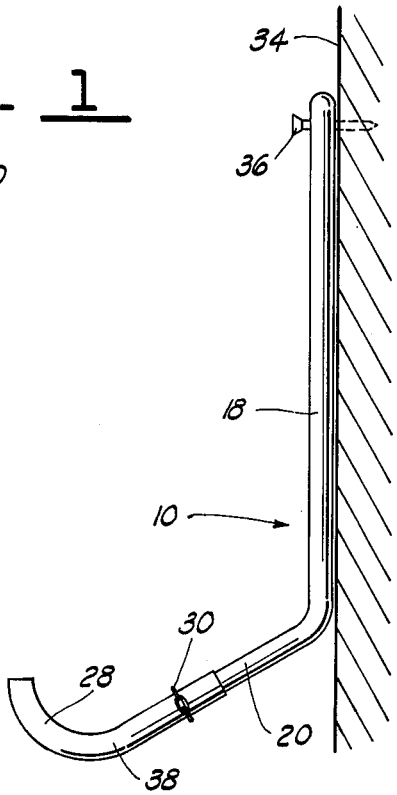
FIG. 3 is a side view of the bracket attached to the side of a wall.

In FIG. 3, a side view of the bracket 10 can be seen with the ring 18 adjacent a wall 34 and having a screw 36 secured thereto for suspending the bracket 10. In this view, the outwardly extending arms 20 can be seen with the ends of the arms 20 curved upwardly forming the hook portions 28 for holding the neck of the musical instrument thereon. The hook portions 28 are covered with a plyable material 38 such as rubber, plastic or the like to protect the surface of the neck of the musical instrument as it is displayed or stored on the bracket 10.

Changes may be made in the construction and arrangement of the parts or elements of the embodiments as disclosed herein without departing from the spirit or scope of the invention as defined in the following claims.

I claim:

1. A bracket for displaying a musical instrument, the bracket comprising:

a vertically disposed resilient ring, said ring open at the lower portion thereof, the ends of said open ring extending outwardly forming arms for receiving the neck of the musical instrument therebetween and suspending the instrument therefrom, the arms disposed parallel and adjacent to each other, the ends of the arms curve upwardly forming hook portions; and an adjustable chain received around the arms of said open ring, by adjusting said chain, the distance between the arms may be varied for receiving musical instruments having different neck widths.

2. The bracket as described in claim 1, wherein said arms are covered with plyable material for protecting the neck of the musical instrument as it is suspended therefrom.

3. A bracket for displaying a musical instrument, the bracket comprising:

a vertically disposed resilient ring, said ring open at the lower portion thereof, the ends of said open ring extending outwardly forming arms for receiving the neck of the musical instrument therebetween and suspending the instrument from the bracket; and an adjustable chain received around the arms of said open ring, by adjusting said chain, the distance between the arms may be varied for receiving musical instruments having different neck widths.

* * * * *